US010125608B2

(12) United States Patent
Moye et al.

(10) Patent No.: US 10,125,608 B2
(45) Date of Patent: Nov. 13, 2018

(54) TEMPORARY SUPPORT AND RAISING DEVICE

(71) Applicant: MMC Innovations LLP, Woodbridge (GB)

(72) Inventors: Thomas Wrigley Moye, Woodbridge Suffolk (GB); David Thomas Marr, Woodbridge Suffolk (GB)

(73) Assignee: MMC INNOVATIONS LLP, Woodbridge (GB)

( * ) Notice: Subject to any disclaimer, the term of this patent is extended or adjusted under 35 U.S.C. 154(b) by 0 days.

(21) Appl. No.: 15/315,543

(22) PCT Filed: Jun. 5, 2015

(86) PCT No.: PCT/EP2015/062602

§ 371 (c)(1),
(2) Date: Dec. 1, 2016

(87) PCT Pub. No.: WO2015/185737

PCT Pub. Date: Dec. 10, 2015

(65) Prior Publication Data

US 2017/0275994 A1 Sep. 28, 2017

(30) Foreign Application Priority Data

Jun. 6, 2014 (GB) ..... 1410112.5

(51) Int. Cl.
*E21D 15/00* (2006.01)
*E21D 15/44* (2006.01)
(Continued)

(52) U.S. Cl.
CPC ..... *E21D 15/44* (2013.01); *E04G 23/04* (2013.01); *E04G 25/065* (2013.01); *E04G 2025/047* (2013.01)

(58) Field of Classification Search
CPC ..... E21D 15/44; E21D 15/445; E21D 15/45; E21D 15/51; E21D 15/517; E04G 25/065; E04G 2025/047; E04G 2025/045
(Continued)

(56) References Cited

U.S. PATENT DOCUMENTS 4,660,806 A 4/1987 Masters
6,394,405 B1 * 5/2002 Roxton ..... E04G 25/04 248/354.1
7,240,885 B1 * 7/2007 Sullivan ..... E04G 25/06 248/351
(Continued)

FOREIGN PATENT DOCUMENTS

EP 0715041 A1 6/1996
FR 2393901 1/1979
(Continued)

*Primary Examiner* — Nkeisha Smith
(74) *Attorney, Agent, or Firm* — Hayes Soloway, PC

(57) ABSTRACT

The support 10 of the present invention resembles a conventional Acrow prop which may be used for temporarily supporting a load. In particular, the present invention is arranged to support a surface at a static position. For example, the surface may comprise a ceiling/beam/lintel within a structure wherein the usual permanent supports for the ceiling/beam/lintel are being replaced or deemed temporarily insufficient. However, the present invention can be used in numerous situations where a support 10 is required and for which the support 10 can be quickly and easily installed. The present invention provides (hydraulic) movement means to move the upper end relative to the lower end. In addition, the present invention provides retraction prevention means to prevent the upper end moving towards the lower end while supporting the load and prevents the inner core member 14 being forcibly retracted back into the outer sleeve member 12 due to the compressive force of the load. A hydraulic ram 22 has a maximum extension limit and the present invention uses an adjustable mounting/abutment mechanism which means that a relatively small hydraulic ram 22 can be installed in the outer sleeve member 12. This size of hydraulic ram 22 will then be suitable for all heights and the support is not limited to simply being moveable within a restricted range.

14 Claims, 4 Drawing Sheets

(51) Int. Cl.
*E04G 25/06* (2006.01)
*E04G 23/04* (2006.01)
*E04G 25/04* (2006.01)

(58) Field of Classification Search
USPC ..... 248/351, 354.1, 354.3, 354.4, 354.5, 248/354.6
See application file for complete search history.

(56) References Cited

U.S. PATENT DOCUMENTS 7,334,968 B2 * 2/2008 Stankus ..... E21D 15/325 248/354.4
7,490,813 B1 * 2/2009 Weddle ..... A62B 3/005 248/354.1
7,837,413 B1 * 11/2010 Kundel, Sr. ..... E02D 17/08 248/354.4
8,016,257 B2 * 9/2011 Di Biase ..... B60D 1/66 248/157
8,418,781 B2 * 4/2013 Chambers ..... A62B 3/005 173/200
9,441,386 B2 * 9/2016 Buckingham ..... E04G 25/061
2004/0081518 A1 * 4/2004 Stankus ..... E21D 15/325 405/294
2004/0223815 A1 * 11/2004 Stankus ..... E21D 15/40 405/288
2008/0056853 A1 * 3/2008 Willis ..... E04G 23/02 414/11
2009/0101774 A1 * 4/2009 Shih ..... E04G 17/14 248/200.1
2013/0146825 A1 6/2013 Buckingham et al.

FOREIGN PATENT DOCUMENTS

FR 2815064 4/2002
GB 2325012 A 11/1998

* cited by examiner

TEMPORARY SUPPORT AND RAISING DEVICE

FIELD OF THE INVENTION

The present invention relates to a support, an assembly comprising a support and a method of supporting a surface.

BACKGROUND TO THE INVENTION

The light construction industry, by way of example, makes use of mechanical, load bearing supports (props), and the most recent and popular versions of which have their origin in a design known as the Acrow. There are now a variety of such products which are available to hire or buy and these are in common use in the building trade around the world.

These mechanical props are limited, however, in terms of how much load may be lifted/supported and it is also well documented that there are considerable health and safety issues during the operation of raising/supporting such loads of varying weights and stresses.

The mining and civil engineering industries make use of elaborate, complex and intricate props which are very costly. Whilst such props may be efficient and safe, they are not simple and quick and easy for use in more routine situations. For example, such props are not very adaptable and they may be bespoke and designed with specific situations in mind. Similarly, fire and rescue teams may encounter situations requiring a support, for example, to support a floor in danger of collapsing. In such situations, time is of the essence and any prop must be simple and easy to install. The emergency personnel will be working under strict time pressures and there may be limited space and visibility in which intricate and complicated operation may hinder the operation. Furthermore, these situations are inherently likely to be risky and any equipment and apparatus would need to be safe and to not pose any explosive risk. Accordingly, electrically operated devices would be detrimental and would be prohibited.

The present invention attempts to overcome some limitations and the present invention aims to provide a temporary support and raising device which is equipped with a number of unique features resulting in highly beneficial savings in terms of labour/cost/time as well as the removal of any issue of health and safety concerns through the deployment of hydraulic and mechanical components that, when combined, facilitate the raising/supporting of a load by means of a straightforward and undemanding process.

It is an aim of the present invention to overcome at least one problem associated with the prior art whether referred to herein or otherwise.

SUMMARY OF THE INVENTION

According to a first aspect of the present invention there is provided a support comprising:

an outer sleeve member;

an inner core member wherein the inner core member is at least partially inserted into the outer sleeve member and at least partially extended outwardly therefrom;

movement means which is arranged, in use, to move the inner core member outwardly from the outer sleeve member, wherein the movement means comprises hydraulic means; and retraction prevention means to prevent the retraction of the inner core member from a support position;

wherein the movement means is mounted in the support at an adjustable position.

Preferably the movement means is mounted in the outer sleeve member at an adjustable position.

The movement means may comprise a support means wherein the support means is arranged to adjustably support the movement means within the support. The support means may be arranged to support the movement means at one of a plurality of set positions within the support.

The support means may comprise fixing means to fix a first end of the movement means to either the inner core member or the outer sleeve member and mounting means to mount a second end of the movement means to the other of either the inner core member or the outer sleeve member.

Preferably the support means comprises fixing means to fix a first end of the movement means to the inner core member and mounting means to mount a second end of the movement means to the outer sleeve member wherein a mounting position of the mounting means is adjustable and preferably is adjustable along a longitudinal direction of the outer sleeve member.

The support means may comprise a support boss which is arranged to support the movement means from the inner core member. Preferably the movement means is fixed to the inner core member.

The support means may comprise a series of apertures through which a support member can engage in order to support the inner core member at predetermined positions relative to the outer sleeve member.

The support means may comprise abutment means to restrict the movement of the movement means relative to the outer sleeve member.

The position of the abutment means may be adjustable within the support to prevent movement of the movement means in a first longitudinal direction within the support.

Preferably the movement means is contained between a support boss and an abutment means. Preferably the initial position of the support boss is adjustable. Preferably the initial position of the abutment means is adjustable. The abutment means may define the lower limit of extent for the movement means in a first direction and the support boss may set the upper limit of extent for the movement means in a second direction. Preferably the abutment means is fixed relative to the outer sleeve member. The support boss may be fixed relative to the inner core member. Accordingly, once both ends of the movement means are engaged respectively with the abutment means and the support boss, further movement of the movement means causes the inner core member to extend telescopically relative to the outer sleeve member.

Preferably the movement means is extendable in a second longitudinal direction. Preferably the movement means extends in the second longitudinal direction until the inner core member locates in the support position. Preferably, an abutment means prevents the movement means from moving in the first longitudinal direction.

Preferably the initial length that the inner core member extends from the outer sleeve member is adjustable.

The movement means may be fixed to the inner core member.

The movement means may be slidably located in the outer sleeve member.

The movement means may be slidably mounted in the outer sleeve member and is securable at an adjustable position within a length of the outer sleeve member.

The movement means may be suspended from the inner core member.

The retraction prevention means may comprise:

a collar engaged on a threaded outer surface of the outer sleeve member;

a slot defined in the outer sleeve member wherein the slot is at least partially within the threaded portion;

an aperture defined in the inner core member; and a retaining member which is locatable through the slot and the aperture.

Preferably the collar is threadably moveable along the threaded portion from an unsupporting position to a supporting position in order for the retraction prevention means to be activated to prevent the inner core member from being retracted into the outer sleeve member.

Preferably the collar is threadably moveable along the threaded portion to move to a support position which a load from a distal end of the inner core member is transmitted through the pin to the collar and to the outer sleeve member and to a lower distal end of the outer sleeve member.

Preferably the inner core member comprises a series of apertures spaced longitudinally along a portion thereof.

Preferably the apertures are provided in pairs with the apertures in a pair being longitudinally aligned but offset radially by 180° around the inner core member.

Preferably the outer sleeve member comprises a pair of slots. Preferably the slots are parallel and longitudinally aligned but offset radially by 180° around the outer sleeve member.

Preferably a first pair of apertures is spaced from a second pair of apertures by a separation distance. Preferably the length of the or each slot is greater than the length of the separation distance.

Preferably the threaded portion extends over a longitudinal length of the outer sleeve member which is greater than the separation distance.

Preferably the threaded portion extends over a longitudinal length of the outer sleeve member which is greater than the longitudinal length of the or each slot.

Preferably the or each slot extends from an upper end to a lower end and wherein both the upper end and the lower end are located within the threaded portion.

Preferably the or each slot extends from an upper end to a lower end and wherein the lower end is located within the threaded portion.

Preferably the movement means comprises a hydraulic ram.

Preferably the hydraulic ram comprises a body and a piston wherein the piston is extendable from the body and retractable into the body.

Preferably the hydraulic ram is mounted in the outer sleeve member.

Preferably the hydraulic ram is moveably mounted in the outer sleeve member.

Preferably the outer sleeve comprises mounting means to mount the hydraulic ram in a plurality of mounting positions.

The mounting means may comprise a series of mounting apertures and preferably comprises a series of pairs of mounting apertures.

Preferably the mounting apertures are spaced longitudinally along the outer sleeve member.

Preferably the mounting apertures are longitudinally aligned but radially offset by 180° around the outer sleeve member.

The mounting means may comprise an abutment pin.

Preferably the abutment pin is engageable through a first mounting aperture and a second mounting aperture within a pair of mounting apertures.

Preferably the piston is extendable from the body up to a maximum extension distance.

Preferably the inner core member is extendable from the outer sleeve member up to a maximum supporting distance.

Preferably the maximum extension distance is less than the maximum supporting distance.

Preferably the outer sleeve member comprises a base plate secured at a distal end thereof.

Preferably the outer sleeve member comprises a boss located at a distal end thereof.

Preferably the boss is dimensioned to fit within an inner surface of the outer sleeve member. The boss may be welded to the outer sleeve member.

The boss may be secured to a base plate. The boss may be welded to the base plate. The boss may be arranged, in use, to locate within the distal end of the outer sleeve member in order to secure the base plate to the distal end of the outer sleeve member.

The base plate may be immovably secured to the outer sleeve member.

The hydraulic ram may comprise an abutment boss. Preferably the abutment boss locates at a distal end of the hydraulic ram and the abutment boss may be engageable with the abutment pin in order to prevent movement of a main body of the hydraulic ram relative to the outer sleeve.

The abutment boss may comprise a projecting portion which is arranged, in use, the project into a recess provided in a distal end of the hydraulic ram.

The piston may comprise a supporting boss located at a distal end thereof. The supporting boss may be arranged, in use, to cooperate with a proximal end of the inner core member. Preferably the supporting boss is arranged, in use, to engage a proximal end of the inner core member.

Preferably the supporting boss is secured to the inner core member and may be welded to the inner core member. The supporting boss may be secured to the distal end of the hydraulic ram. The supporting boss may be secured to the distal end of the hydraulic ram by one or more (grub) screws.

The hydraulic ram may be suspended from the inner core member.

The hydraulic ram may be contained between an abutment pin secured within the outer sleeve member and the supporting boss secured to the inner core member. Accordingly extension of the piston from the main body of the hydraulic ram may cause movement of the inner core member relative to the outer sleeve member. Preferably extension of the piston causes the supporting boss and the inner core member to move (upwards) relative to the outer sleeve member.

Preferably the supporting boss is secured to an end of a piston of the hydraulic ram.

The supporting boss may comprise a recess into which a distal end of the ram is arranged to be retained. The supporting boss may comprise securement means to secure the distal end of the ram in the supporting boss. The securement means may comprise a (grub) screw.

The supporting boss may comprise a shoulder into which a proximal end of the inner core member is supportable. The supporting boss may comprise an outer shoulder which is defined around an outer periphery thereof onto which a proximal end of the inner core member is supportable.

The boss may comprise a central portion. The central portion may be engageable with a proximal end of the inner core member. Preferably the central portion is locatable into the proximal end of the inner core member.

The movement means may be connectable to a pump. The pump may be arranged to actuate the movement means.

Preferably the pump is removably connectable to the movement means and the pump may be subsequently used to (or is able to) actuate a plurality of supports in accordance with the present invention.

According to a second aspect of the present invention there is provided a support assembly comprising a structure and a support for supporting the structure, the support comprising:

an outer sleeve member;

an inner core member wherein the inner core member is at least partially inserted into the outer sleeve member and at least partially extended outwardly therefrom;

movement means which is arranged, in use, to move the inner core member outwardly from the outer sleeve member, wherein the movement means comprises hydraulic means; and retraction prevention means to prevent the retraction of the inner core member from a support position;

wherein the movement means is mounted in the outer sleeve member at an adjustable position.

According to a third aspect of the present invention there is provided a method of supporting a structure comprising locating a support adjacent to a surface of the structure, the support comprising:

an outer sleeve member;

an inner core member wherein the inner core member is at least partially inserted into the outer sleeve member and at least partially extended outwardly therefrom;

movement means, wherein the movement means comprises hydraulic means; and retraction prevention means;

the method comprising:

adjusting the position of the movement means in the outer sleeve member actuating the movement means and moving the inner core member outwardly from the outer sleeve member to a supporting position; and actuating the retraction prevention means to prevent the retraction of the inner core member from the supporting position.

According to a fourth aspect of the present invention there is provided a support comprising:

an outer sleeve member;

an inner core member wherein the inner core member is at least partially inserted into the outer sleeve member and at least partially extended outwardly therefrom;

movement means which is arranged, in use, to move the inner core member outwardly from the outer sleeve member, wherein the movement means comprises hydraulic means; and retraction prevention means to prevent the retraction of the inner core member from a support position;

the retraction prevention means comprising:

a collar engaged on a threaded outer surface of the outer sleeve member;

a slot defined in the outer sleeve member wherein the slot is at least partially within the threaded portion;

an aperture defined in the inner core member; and a retaining member which is locatable through the slot and the aperture;

wherein the collar is threadably moveable along the threaded portion from an unsupporting position to a supporting position in order for the retraction prevention means to be activated to prevent the inner core member from being retracted into the outer sleeve member.

According to a fifth aspect of the present invention there is provided a support assembly comprising a structure and a support for supporting the structure, the support comprising:

an outer sleeve member;

an inner core member wherein the inner core member is at least partially inserted into the outer sleeve member and at least partially extended outwardly therefrom;

movement means which is arranged, in use, to move the inner core member outwardly from the outer sleeve member, wherein the movement means comprises hydraulic means; and retraction prevention means to prevent the retraction of the inner core member from a support position;

the retraction prevention means comprising:

a collar engaged on a threaded outer surface of the outer sleeve member;

a slot defined in the outer sleeve member wherein the slot is at least partially within the threaded portion;

an aperture defined in the inner core member; and a retaining member which is locatable through the slot and the aperture;

wherein the collar is threadably moveable along the threaded portion from an unsupporting position to a supporting position in order for the retraction prevention means to be activated to prevent the inner core member from being retracted into the outer sleeve member.

According to a sixth aspect of the present invention there is provided a method of supporting a structure comprising locating a support adjacent to a surface of the structure, the support comprising:

an outer sleeve member;

an inner core member wherein the inner core member is at least partially inserted into the outer sleeve member and at least partially extended outwardly therefrom;

movement means wherein the movement means comprises hydraulic means; and retraction prevention means comprising:

a collar engaged on a threaded outer surface of the outer sleeve member;

a slot defined in the outer sleeve member wherein the slot is at least partially within the threaded portion;

an aperture defined in the inner core member; and a retaining member which is locatable through the slot and the aperture;

the method comprising:

adjusting the position of the movement means in the outer sleeve member;

actuating the movement means and moving the inner core member outwardly from the outer sleeve member to a supporting position; and threadably moving the collar along the threaded portion from an unsupporting position to a supporting position in order for the retraction prevention means to be activated to prevent the inner core member from being retracted into the outer sleeve member.

BRIEF DESCRIPTION OF THE DRAWINGS

The present invention will now be described, by way of example only, with reference to the drawings that follow, in which.

DESCRIPTION OF THE PREFERRED EMBODIMENTS

The present invention relates to a temporary semi-automatic hydraulic load bearing raising and support device for use across a wide variety of industries. The support may also be considered to be one of the following: a temporary Support device/prop, a temporary raising device/prop, a semi-automatic raising and support device, a temporary load bearing lifting and support device/prop or a temporary hydraulic support and lifting device.

Figure 1:
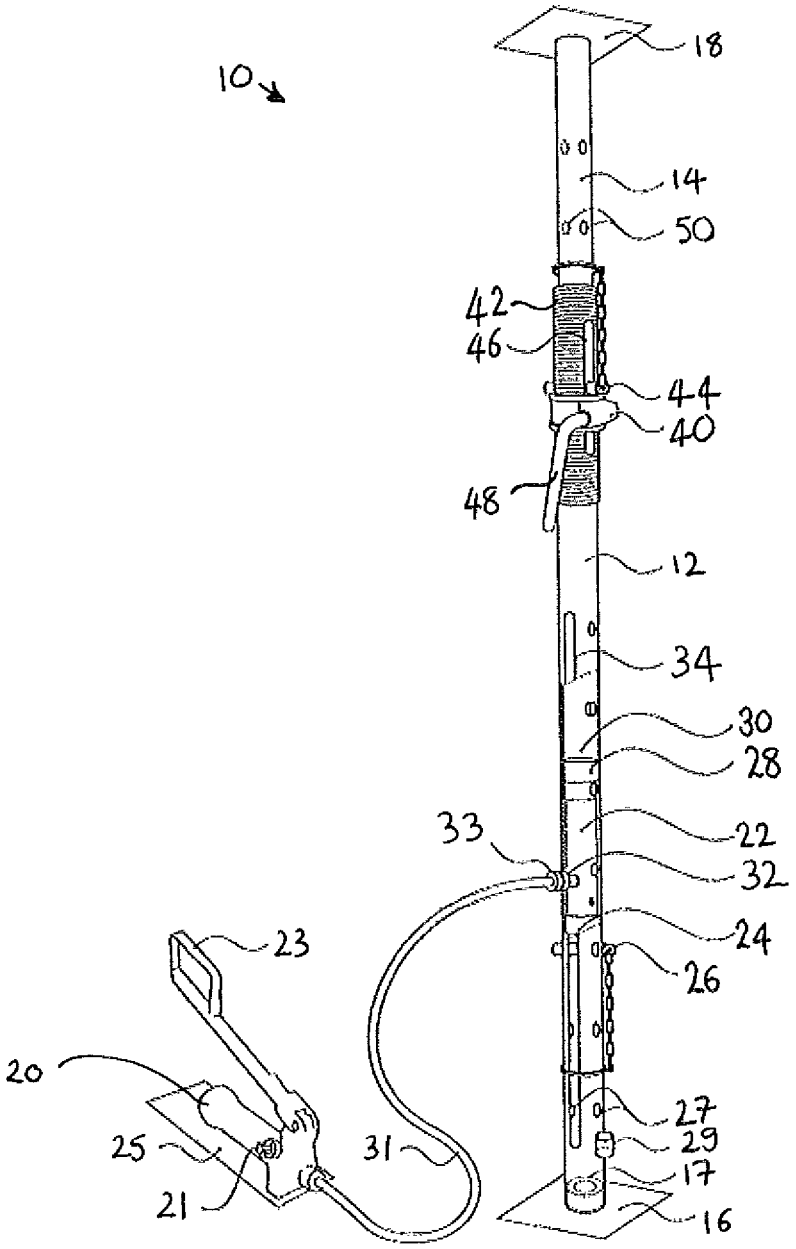
FIG. 1 is a perspective partially cut away view of a preferred embodiment of a support in a vertical orientation.
Figure 2:
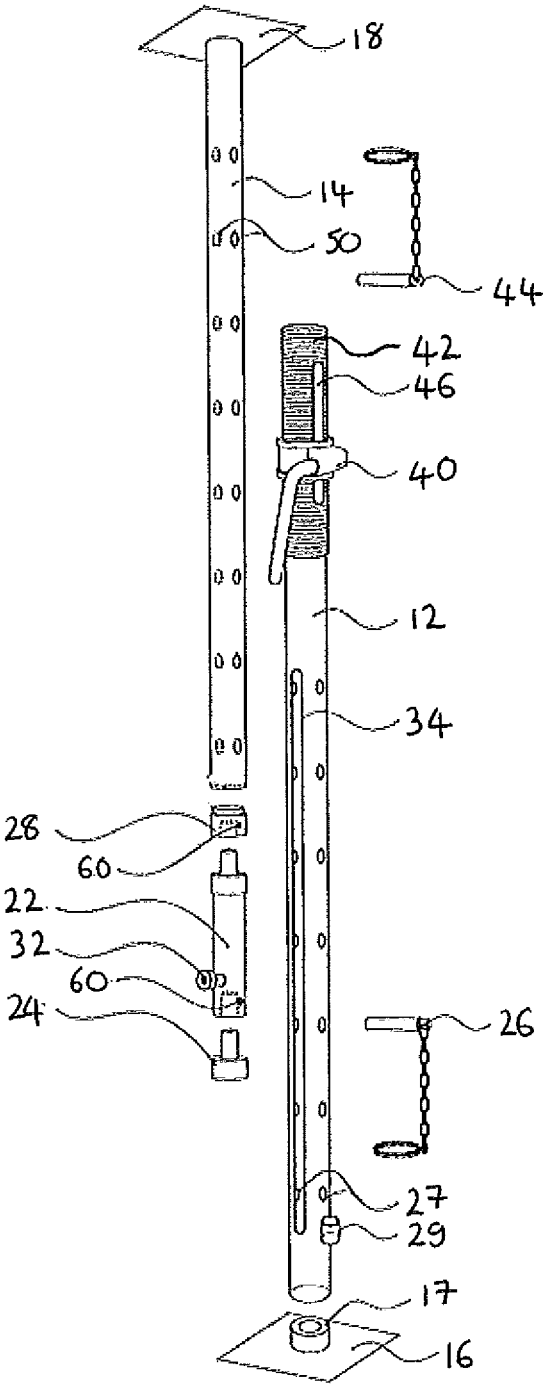
FIG. 2 is an exploded view of a preferred embodiment of a support in a vertical orientation.

As shown in FIG. 1 and FIG. 2, the support 10 resembles a conventional Acrow prop which may be used for temporarily supporting a load. In particular, the present invention is arranged to support a surface at a static position. For example, the surface may comprise a ceiling/beam/lintel within a structure wherein the usual permanent supports for the ceiling/beam/lintel are being replaced or deemed temporarily insufficient. However, the present invention can be used in numerous situations where a support 10 is required and for which the support 10 can be quickly and easily installed.

Figure 3:
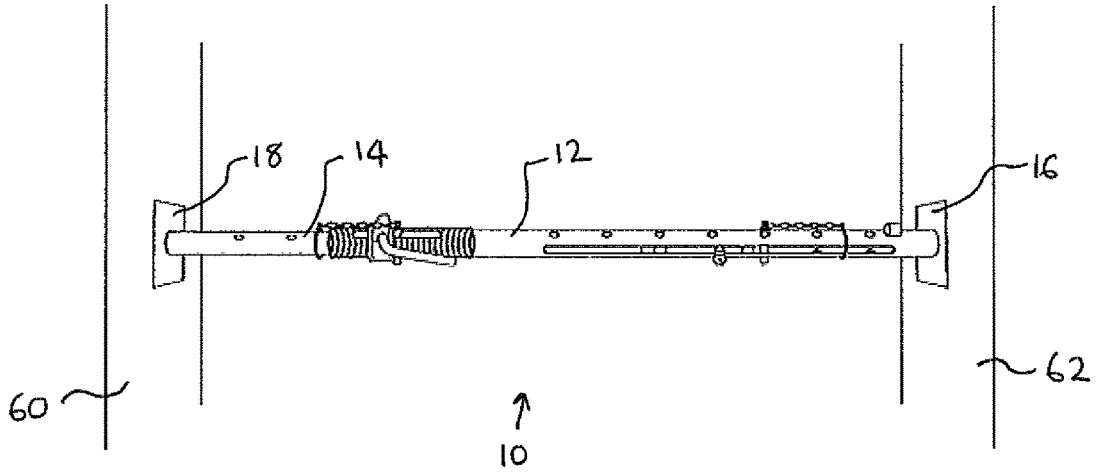
FIG. 3 is a perspective view of a preferred embodiment of the present invention in a horizontal orientation between two walls/surfaces.

As shown in FIG. 3, the present invention can also be used to retain two surfaces at a predetermined horizontal distance rather than at a predetermined vertical spaced distance shown in FIG. 1 and FIG. 2. However, the specific preferred embodiment will now be described in relation to a vertical arrangement in which the support 10 is being used to temporarily support a ceiling/beam/lintel from a floor within a structure.

As shown in FIG. 1 and FIG. 2, the support 10 comprises an outer sleeve member 12 and an inner core member 14. The outer sleeve member 12 and the inner core member 14 are arranged to provide a telescopic support 10 such that the inner core member 14 is at least partially located or contained within the outer sleeve member 12.

The lower or proximal end of the inner core member 14 is located within the outer sleeve member 12 whereas the upper or distal end of the inner core member 14 is located spaced from the upper or proximal end of the outer sleeve member 12. The upper end of the inner core member 14 comprises an upper plate 18 which is arranged to abut and engage with the surface/structure to be supported. The lower or distal end of the outer sleeve member 12 comprises a lower plate 16 which is arranged to be supported on the supporting surface, for example the ground or floor. Accordingly, the distal end of the inner core member 14 provides the upper end of the support 10 whereas the distal end of the outer sleeve member 12 provides the lower end of the support 10. As previously mentioned, the support 10 is effectively telescopic such that the distance between the upper end and the lower end is adjustable.

The present invention provides (hydraulic) movement means to move the upper end relative to the lower end. In addition, the present invention provides retraction prevention means to prevent the upper end moving towards the lower end whilst supporting the load and prevents the inner core member 14 being forcibly retracted back into the outer sleeve member 12 due to the compressive force of the load.

In a conventional Acrow prop, a collar 40 is manually moved by a user and is threaded upwardly whilst engaged with a pin 44 passing through apertures 50 in the inner core member 14. However, this threading movement of the collar 40 becomes very difficult as the load is being transferred through the pin 44 to the collar 40. On site, it may be conventional or usual practice for a hammer or other implement to be used to strike an attached arm 48 of the collar 40 in order to try and rotate the collar 40 to a desired position. Obviously, such a method is not satisfactory in that the position of the entire prop may be moved, the prop and/or supporting surfaces may be damaged and there are inherent health and safety issues in such adjustments. Overall, it can be difficult to generate sufficient upward lifting forces using a conventional Acrow prop. Without physically striking the collar, this force will be limited to the rotational force that a user(s) can manually place on the collar. This can be exacerbated in confined or restricted locations where it can be difficult to strike the attached arm of the collar 40 with a suitable implement, for example when an Acrow prop is required to be located adjacent to a wall.

The present invention provides movement means in order to negate the use of striking forces to raise the support. The movement means provides an upwards or lifting force sufficient for the task. In particular, a hydraulic ram 22 is moveably mounted in the support 10 and this is used to generate the required lifting force. Furthermore, the present invention has a similar collar 40 arrangement to that in a standard Acrow prop in order to prevent the support 10 from retracting telescopically once correctly in position. This collar 40 arrangement provides a mechanical retraction prevention mechanism which may supplement the compression resistance provided by the hydraulic ram 22.

The upper end of the outer sleeve member 12 comprises a threaded portion on an outer surface thereof. The collar 40 is threadably engaged and can be manually threaded up and down this portion. The collar 40 is provided with an attached arm 48 to aid the manual rotation of the collar 40.

The inner core member 14 comprises a series of pairs of apertures 50 along the length thereof. Each aperture 50 in a pair is longitudinally aligned but the apertures 50 are radially offset by 180°. Adjacent pairs of apertures 50 are spaced apart by a separation distance.

The outer sleeve member 12 comprises two longitudinally extending slots 46 which are parallel and longitudinally aligned but these two slots 46 are offset radially by 180°. These two slots 46 are defined within the threaded portion 42 of the outer sleeve member 12. Each slot 46 has an upper end and a lower end which are both located or positioned within the threaded portion 42, i.e. the two diametrically opposed slots 46 are entirely within the threaded portion 42.

The support 10 is provided with a pin 44. The pin 44 is engageable through the two slots 46 in the outer sleeve member 12 and the pin 44 is also engageable through a pair of apertures 50 provided in the inner core member 14. This engagement thereby fixes the inner core member 14 to the outer sleeve member 12 and confines the relative movement therebetween within the limits of the movement of the pin 44 within the slots 46. However, the collar 40 is arranged to locate below the pin 44 such that the pin 44 rests on the upper surface of the collar 40.

As previously mentioned, the support 10 is provided with movement means in the form of a hydraulic ram 22. This hydraulic ram 22 comprises a main body and a piston which is extendable upwardly relatively therefrom.

Figure 4:
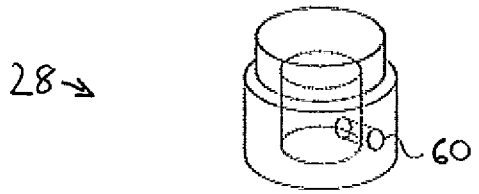
FIG. 4 is a perspective view of a preferred embodiment of a support boss.

The piston includes a support boss 28 located or secured at the distal end thereof, as shown in FIG. 4. The support boss 28 comprises an outer engagement shoulder which is arranged to cooperate with the lower proximal end of the inner core member 14.

The main body of the hydraulic ram 22 is arranged to engage at a distal end with mounting means. The mounting means is adjustable such that the lowermost position of the hydraulic ram 22 within the outer sleeve member 12 can be adjusted.

Figure 5:
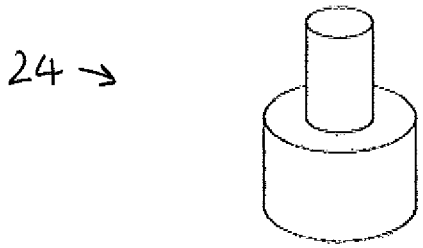
FIG. 5 is a perspective view of a preferred embodiment of a mounting boss.

The mounting means comprises an abutment boss 24 (as shown in FIG. 5) which is arranged to be secured to the distal end of the main body of the hydraulic ram 22 by a grub screw(s) 60. In this way, the hydraulic ram 22 is integral with the abutment boss 24 and the abutment boss provides a protective abutting surface for the base of the hydraulic ram 22. The abutment boss 24 comprises a central projecting portion which is arranged for projection into a corresponding recess provided on the distal end of the main body of the hydraulic ram 22.

The outer sleeve member 12 comprises a series of pairs of mounting apertures 27 through which the abutment pin 26 can extend. In use, the abutment pin 26 is located through a pair of mounting apertures 27.

The hydraulic arm is suspended from or fixed to the inner core member 14. The initial positional height of the hydraulic ram 22 within the outer sleeve member 12 is controlled and adjusted through the movement of the abutment pin 26 in the required pair of mounting apertures 27. This provides lowermost position of the hydraulic ram 22 within the outer sleeve member 12 and is set by the position of the abutment pin 26. A hydraulic ram 22 has a maximum extension limit and this adjustable mounting/abutment mechanism means that a relatively small hydraulic ram 22 can be installed in the outer sleeve member 12. This size of hydraulic ram 22 will then be suitable for all heights and the support is not limited to simply being moveable within a restricted range.

Furthermore, the use of a self contained hydraulic ram 22 has many benefits compared to the use of a simple integral pneumatic system. A simple pneumatic system could use an air chamber to raise (and lower) the inner core member 14 out of the outer sleeve member 12. However, such a system would be difficult to manufacture and assemble due to the sealing requirements. Furthermore, air (or gas) is inherently more compressible and is more influenced by environmental conditions (for example temperature) when compared to a hydraulic system. In addition, a pneumatic system may require a power source which may be a hindrance in some situations.

The hydraulic ram 22 comprises a coupling 32 which extends laterally from the main body. This coupling 32 is arranged to extend through a coupling slot 34 provided in the outer sleeve member 12. As shown in FIG. 1 and FIG. 2, this coupling slot 34 extends longitudinally along a length of the outer sleeve member 12. This coupling slot 34 helps to define the limit of placement for the hydraulic ram 22 since the hydraulic ram 22 can only be located at a position where the coupling 32 can extend through the coupling slot 34. In this regard, the pairs of mounting apertures 27 are also positioned adjacent to (but 90° offset) from this coupling slot 34.

A buffer boss 17 located at the bottom of the outer sleeve member 12 restricts the lowermost position of the inner core member 14. In particular, at the lowermost position, the inner core member 14 is supported on the buffer boss 17 whilst the coupling 32 is spaced from the lowermost end of the coupling slot 34. This prevents the coupling 32 from being sheared off if the inner core member 14 is allowed to fall freely down within the outer sleeve member 12. The coupling 32 may be removable to enable the hydraulic ram 22 to be inserted into or extracted from the outer sleeve member 12.

In some embodiments, the buffer support 10 does not include a buffer boss 17. In such embodiments, an extended mounting boss 24 may be used to provide the buffering function and to prevent the coupling 32 from being sheared off by the inner core member 14 moving uncontrolled within the outer sleeve member 12. This arrangement may not actually save on material costs but may involve fewer weld joints which may decrease production time and may increase reliability due to the simple configuration. The extended mounting boss 24 may comprise an extended cylindrical section in order to abut the base plate 16 before the coupling 32 reaches the bottom arcuate section of the coupling slot 34.

The buffer boss 17 is welded to the base plate 16 and the buffer boss 17 is also welded to the outer sleeve member 12. Similarly, the upper end of the inner core member 18 is welded to the top plate 18. However, the top plate may provide a central aperture corresponding with the internal volume of the inner core member such that an adaptor plate can be engaged with the top plate 18. For example, a U-shaped supporting bracket could be used at the upper end for use with supporting a beam or the like. This may help to prevent the beam slipping relative to the support 10. The adaptor may be provided with a cylindrical core projection which could be simply inserted through the central aperture of the top plate 18 and located within the inner core member.

The coupling 32 enables a pump 20 to be releasably coupled to the hydraulic ram 22. The pump 20 includes a flexible or resilient hose 31 which extends from the pump body to the main body of the hydraulic ram 22. In the preferred embodiment, the pump comprises a foot pump 20 having a handle with a foot portion 23. This foot portion 23 enables the foot of a user to be engaged thereon in order for a user to actuate the pump 20. The pump 20 also includes a base 25 to provide stability for the pump 20 whilst in use.

The pump 20 includes a release valve 21 to enable the hydraulic pressure within the hydraulic ram 22 to be lowered and released. This release valve 21 may comprise a feathered valve to allow the hydraulic pressure to be released gradually and slowly form the hydraulic ram 22.

The pump 20 enables a user to step on the handle in order to increase the hydraulic pressure within the hydraulic ram 22. This thereby extends the piston upwardly as required by the user.

The pump is 20 removable through the use of the releasable coupling 32 such that the pump 20 can be used with a number of supports 10 in accordance with the present invention. Each support 10 does not require a dedicated pump and this is highly advantageous. The connection coupling 32 and coupling 33 may comprise a quick release coupling. In particular, the connection coupling 32 may comprise a push fit and/or snap fit arrangement to quickly, easily and reliably secure the pump 20 to the ram 22.

The abutment pin 26 is connected to a retaining chain and a retaining collar. These retaining components ensure that the abutment pin 26 is continuously connected to and retained to the outer sleeve member 12. This prevents the abutment pin 26 from being misplaced or lost, for example during transit. The outer sleeve member 12 further comprises a retaining bracket 29 into which the abutment pin 26 can be retained when the abutment pin 26 is not extending through the mounting apertures 27.

Similarly, the pin 44 is connected to a retaining chain and retaining collar. Again, these retaining components are arranged to retain the pin 44 to the support 10, especially during transit.

In use, the support 10 is placed in the correct location on the ground and below the part of the ceiling/beam/lintel to be supported. With the adjustable collar 40 in a lower position, the pin 44 is removed and the inner core member 14 (and hydraulic ram) is manually (for example, by hand moving the connection coupling upwards) moved upwardly until the top plate 18 abuts the ceiling/beam/lintel. The abutment pin 26 is then engaged in the highest available pair of apertures 27. The position of these apertures 27 may mean that the top plate 18 is spaced slightly away from the ceiling/beam/lintel such that the top plate 18 is spaced slightly from the ceiling/beam/lintel.

The upper pin 44 is then engaged through the first available pair of mounting apertures 50 located above the collar 40.

Once all the components are in position, the pump 20 (if not already) is coupled to the hydraulic ram 22. The user then pumps up the hydraulic ram 22 which causes the piston to extend upwardly from the main body and this will move the inner core member 14 upwardly. In this configuration, the mounting pin 26 act as a base and the actuation of the hydraulic ram 22 causes the piston together with the inner core member 14 to move upwardly. The piston and the inner core member 14 act as a unitary component due to the securement through the supporting boss 24.

The actuation of the hydraulic ram 22 moves the inner core member 14 out of the outer sleeve member 12. This movement is continued until the top plate 18 abuts the ceiling/beam/lintel. The pumping can be continued in order to lift and/or attempt to lift the ceiling/beam/lintel. This creates an upwards force on the ceiling/beam/lintel. Once a sufficient force has been created, the pumping can cease and the mechanical retraction prevention mechanism can be actuated or operated.

The adjustable collar 40 is now freely threaded upwardly in order for the upper surface of the adjustable collar 40 to engage underneath both projecting portions of the pin 44. The collar 40 does not need to be forcibly rotated in order to sufficiently engage the pin 44.

Once positioned, the support 10 of the present invention can easily be adapted so the load may be supported, indefinitely, through its proven mechanical solution of an adjustable collar fixed to the thread at the top of the outer sleeve. A detachable hydraulic pump, which has been engaged to complete the raising/supporting element of the process, may then be detached for use on a second such support and so on, as and if required.

In summary, the initial placement of the lower pin (the abutment pin 26) is used to secure the top plate as close to the ceiling/beam/lintel (support surface) as possible. The ram 22 then rests and is supported on this lower pin 26. Once in this position, the upper pin 44 is then secured in the holes 50 which are accessible through the upper slots 46. Following this, the ram 22 is actuated and then the collar 40 is wound up to retain the position.

In this configuration, the top plate 18 is retained in position both by the hydraulic pressure within the ram 22 and also by the mechanical engagement of the collar 40. This dual support may be a useful safety feature. For example, the hydraulic pressure may decrease over a prolonged period and the mechanical engagement will thereby become dominant. However, in most situations, the hydraulic pressure can be released in order for the mechanical engagement to be the sole retaining mechanism. In this position, the compressive force may be sufficient to prevent any manual rotation of the collar 40. Accordingly, the hydraulic ram 22 may be required to be reactivated and extended in order to release the pressure to enable the collar 40 to move downwardly and for the support 10 to be subsequently removed.

The pump is generally removed from the assembly and this will then enable the pump to be used with other supports 10. The feathered valve 21 is operated in order to release the hydraulic fluid from the main body of the hydraulic ram 22 and the pump 20 can then be simply uncoupled from the hydraulic ram 22. The feathered valve 21 enables a very slow release of the hydraulic fluid, if required, and it is not just a valve that is either open or closed.

During the use of the support 10, it is always possible to use the hydraulic ram 22 to ensure the prop 10 is correctly located. The pump 20 can be used to see if the top plate 18 can be extended further and the collar 40 can be subsequently moved upwardly to a new position. In such a case an additional support would be required prior to the original support being repositioned. In this situation, the pump 20 could be simply reattached to move the top plate 18 up to an optimum position. Alternatively the raising of the piston may need to extend beyond its initial limit. This would be facilitated by the movement of the integral ram 22 upwards so that it may be located in a new position. Clearly and prior to disengaging the support 10 to achieve this a further temporary support would need to be positioned adjacent to it so that load being raised was temporarily supported pending the reintroduction of the hydraulics from a new, higher mounting position in the first support 10. Either this or the original temporary support could remain in situ and secured on the collar 40 whist a second such support was deployed in order to take the load to be raised to another level or its final position Once the requirement for the temporary support and raising device 10 is over, the support 10 can be removed. To remove the support 10, the pump 20 may be required to initially raise the inner core member 14 slightly such that the collar 40 can be easily manually rotated from below the pin 44. In this position, the collar 40 is threaded downwardly to a suitable position. The feathered valve 21 can then be operated in order to release the hydraulic fluid from the main body of the hydraulic ram 22. This will cause the top plate 18 to move downwardly. Once at a suitable position, the support 10 can then be simply removed. The pump 20 can be uncoupled for transport and/or storage reasons. The support 10 can be retained as a single unit but can be retracted to a minimum height again for transit and/or storage purposes.

The support 10 will lift a variety of weights and support loads and stresses of equally varying degrees and typically it will be deployed vertically but it will also work as efficiently in a horizontal position.

All materials are mild steel with the exception of:

(i) adjustable collar—cast iron (ii) hose—high pressure, reinforced rubber compound incorporating steel braid (iii) ram—mild steel casing with plastic surround For ease of further reference, the list of components for a specific embodiment of the present invention is as follows:

12 Outer Sleeve

34 Slot in Outer Sleeve

27 Series of Spaced Holes, in parallel on two sides, cut into lower section of Outer Sleeve

26 Removable Pin attached by Chain and Ring to Outer Sleeve

14 Inner/Telescopic Sleeve
40 Adjustable Collar with Attached Arm secured to Thread at top of Outer Sleeve
42 Section of Thread with slot at top of Outer Sleeve
50 Series of Spaced Holes, in parallel on two sides cut into Inner/Telescopic Sleeve
44 Removable Pin attached by Chain and Ring to Inner/Telescopic sleeve
16 Attached Base Plate
18 Attached Top Plate
32 Connection Coupling on Integral Ram
22 Integral Ram in Outer Sleeve
28 Boss secured to top of Integral Ram
28 Boss secured to bottom of Inner/Telescopic Sleeve
24 Boss secured to bottom of Integral Ram
17 Boss secured to Base Plate
29 Removable Pin Storage Bracket on Outer Sleeve
33 Hydraulic Inlet & Coupling to fit to Connection Coupling on Integral Ram
60 Grub Screws to secure Supporting Boss A and Abutment Boss to Integral Ram As previously explained, the temporary support and raising device 10 contains elements of a traditional style mechanical 'Acrow' prop, namely: an outer sleeve 12, an inner/telescopic sleeve 14, an attached base plate 16, an attached top plate 18, a series of spaced holes 50, in parallel on two sides cut into the inner/telescopic sleeve 14, an adjustable collar 40 with attached arm 48 which is secured to a section of thread 42 with two slots 46 at the top of the outer sleeve 12 (the collar 40 will move upwards or downwards on the thread 42 when the attached arm 48 is turned either clockwise or anti-clockwise), a removable pin 44, attached to the inner/telescopic sleeve 14 by a chain and ring which will enable it to slide up and down the inner/telescopic sleeve 14.

There are a number of unique modifications to the traditional style mechanical prop, namely:

(i) series of spaced holes 50, in parallel on two sides, cut into the outer sleeve 14
(ii) slot 34 cut into outer sleeve 12
(iii) an integral ram 22 positioned within the outer sleeve 12
(iv) connection coupling 32 of integral ram 22
(v) removable pin 26, attached to the outer sleeve 12 by a chain and ring which will enable it to slide up and down the outer sleeve 12 beneath the integral arm 22
(vi) removable pin storage bracket 29 on the outer sleeve 12
(vii) boss 28 secured to the top of the integral ram by three grub screws 60 and welded at the other end to the bottom of inner/telescopic sleeve 14
(viii) boss 24 secured by the three grub screws 60 at the bottom of the integral ram
(ix) boss 17 welded to the base plate 16
(x) the outer sleeve 12 is positioned over boss 17 and welded to the base plate 16 thereby making the integral ram 22 tamper proof.

In addition a hydraulic inlet and coupling 33 connect to the connection coupling 32 on the integral ram 22.

Example of Dimensions

In this example the temporary support and raising device 10 may be used vertically to raise or support a load up to a maximum height of 3 m and a maximum load of up to 2 Tonnes. Key dimensions are as follows:

1. LENGTH OF OUTER TUBE: 1650 mm
2. LENGTH OF INNER TUBE: 1645 mm
3. DIAMETER OF OUTER TUBE: 60 mm
4. DIAMETER OF INNER TUBE: 48 mm
5. THICKNESS OF OUTER TUBE: 3 mm
6. THICKNESS OF INNER TUBE: 4 mm
7. NUMBER OF SPACED HOLES IN INNER TUBE: 9
8. NUMBER OF SPACED HOLES IN OUTER TUBE: 8
9. DISTANCE APART OF SPACED HOLES IN THE INNER TUBE: 140 mm centre-to-centre
10. DISTANCE APART OF SPACED HOLES IN THE OUTER TUBE: 120 mm centre-to-centre
11. MEASUREMENT OF DISTANCE FROM CENTRE OF TOP HOLE IN THE INNER TUBE TO TOP PLATE: 460 mm
12. MEASUREMENT OF DISTANCE FROM CENTRE OF BOTTOM HOLE IN OUTER TUBE TO BASE PLATE: 130 mm
13. LENGTH OF THREAD AT TOP OF OUTER TUBE: 280 mm
14. MEASUREMENTS OF THE TWO SLOTs AT TOP OF OUTER SLEEVE: 175 mm long×16 mm wide
15. MEASUREMENTS OF SLOT AT BOTTOM OF OUTER SLEEVE: 970 mm long×15 mm wide
16. TOP PLATE DIMENSIONS: 150 mm sq×8 mm thickness
17. BOTTOM PLATE DIMENSIONS: 150 mm sq×8 mm thickness
18. DIMENSIONS OF BOTH PINS: 16 mm round—100 mm long
19. DIMENSIONS OF COLLAR: 80 mm dia—40 mm high
20. DIAMETER OF PIN HOLES IN OUTER TUBE: 18 mm
21. DIAMETER OF PIN HOLES IN INNER TUBE: 18 mm
22. DIAMETER OF RAM: 40 mm
23. LENGTH OF RAM—UNEXTENDED: 270 mm
24. LENGTH OF RAM—FULLY EXTENDED: 390 mm
25. LENGTH OF HOSE: 1.5 meters (not fully illustrated)
26. LENGTH OF PUMP: 350 mm (not illustrated)
27. DIAMETER OF PUMP: 60 mm (not illustrated)
28. LENGTH OF HANDLE: 450 mm (not illustrated)
29. DIMENSIONS OF METAL PEDAL MODIFICATION: 16 mm depth×5 mm thick×80 mm high×120 mm wide (not illustrated)
30. PUMP BASE PLATE DIMENSIONS: 450 mm long×100 mm wide×10 mm thick (not illustrated)

Example Dimensions of the Bosses (×3)

Figure 6:
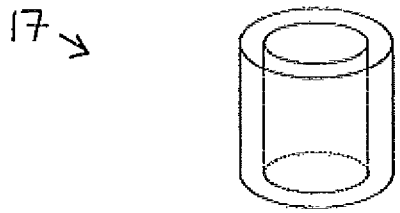
FIG. 6 is a perspective view of a preferred embodiment of a securement boss.

Supporting Boss 28 (see FIG. 4)
Overall Height: 35 mm
Overall diameter: 46 mm
Height of Lip (Top): 10 mm
With of recess to lip (Top): 5 mm
Diameter of hole (bottom): 22 mm
Depth of Hole: 25 mm
Recess diameter (bottom): 12 mm Abutment Boss 24 (see FIG. 5)
Overall Height: 55 mm
Overall diameter: 46 mm
Diameter at top: 20 mm
Recess at top: 13 mm
Height of lip at top: 30 mm Buffer Boss 17 (see FIG. 6)
Overall height: 40 mm
Overall diameter: 42 mm
Diameter of Hole: 26 mm
Width/diameter of recess: 7 mm When using the temporary support and raising device vertically, for example, it is positioned beneath the load to be raised/surface to be supported. Whilst holding the outer sleeve 12 and ensuring the attached base plate 16 is level and stable and with both removable pins disengaged 44, 26 the inner/telescopic sleeve 14 is raised upwards in the slot 34 in the outer sleeve 12 so that the attached top plate 18 may be positioned as close as possible to the load to be raised/surface to be supported. This may be achieved by the raising of the inner/telescopic sleeve itself or by lifting the connection coupling 32 on the integral ram 22 which protrudes from the outer sleeve 12—both of which will achieve the same result. The nearest achievable distance between the top plate 18 and the load to be raised/surface to be supported will be determined by the closest available spaced holes 27, in parallel on two sides, cut into the outer sleeve 12 directly beneath the integral ram in the outer sleeve 12.

The removable pin 26 for use with the outer sleeve 12 is then positioned, if necessary, by sliding the ring attached to the chain upwards, and engaged through the closest available spaced holes 27 in parallel on two sides, cut into the outer sleeve 12 directly beneath the integral ram 22 thereby securing the inner/telescopic sleeve 14 in the optimum position with the attached top plate 18 being as close as possible to the load to be raised/surface to be supported.

The removable pin 44 for use with the inner/telescopic sleeve 14 should then be placed through the section of thread 42 with two slots 46 at the top of the outer sleeve 12 and into the available spaced holes 50, in parallel on two sides, cut into the inner/telescopic sleeve 14 above the adjustable collar 40 with attached arm 48. This may mean the collar 40 will need to be lowered on the section of thread 42 with two slots 46 by turning its attached arm 48 anti-clockwise prior to engaging the removable pin 44. Once this removable pin 44 is engaged, the hydraulic inlet and coupling 33 can be connected to the connection coupling 32 on the integral ram 22.

The temporary support and raising device 10 is now ready for use and hydraulic fluid is now pumped under pressure into the integral ram 22 in the outer sleeve 12 and the internal piston in the integral ram 22 will start to extend which will cause the inner/telescopic sleeve 14 to slowly rise until the attached top plate 18 engages with the load to be raised/surface to be supported. This process continues until the exact positioning has been achieved as a result of fine and precise adjustment.

The adjustable collar 40 is then immediately rotated upwards on the thread 42 with two slots 46 by turning its attached arm 48 clockwise until the collar 40 engages beneath the removable pin 44 in the inner/telescopic sleeve 14.

The hydraulic pump 20 should now be disengaged by thereby enabling the fluid to flow from the integral ram 22 back into the hydraulic storage reservoir inside its pump 20. The internal piston in the integral ram 22 will retract and the hydraulic inlet and coupling 33 may then be released from the connection coupling 32 on the integral ram 22 thereby enabling the hydraulic pump 20 to be removed, if required, for use elsewhere on a second such temporary support and raising device and so on. The load/surface is now completely supported on the mechanical adjustable collar 40 of the temporary support and raising device with no reliance whatsoever on the hydraulic system, which has been completely disabled.

To lower and remove the temporary support and raising device 10 firstly make sure the removable pin 26 is in position in the outer sleeve 12 as before, the hydraulic inlet and coupling 33 must be connected once again to the connection coupling 32 on the integral ram 22 and the hydraulic pump 20 made ready for use. The hydraulic fluid is then pumped under pressure into the integral ram in the outer sleeve 12 and the internal piston in the integral ram 22 will start to extend and the process continues until it engages fully once more on the load/surface being supported exactly as during the initial process of raising the load/supporting the surface.

The adjustable collar 40 is then rotated downwards on the thread 42 with two slots 46 by turning its attached arm 48 anti-clockwise so that the collar 40 disengages beneath the removable pin 44 in the inner/telescopic sleeve 14. Whilst holding/securing the outer sleeve 12, the hydraulic pump 20 should now be disengaged by turning the feathered valve 21 thereby enabling the hydraulic fluid to flow from the integral ram 22 back into the hydraulic storage reservoir inside its pump 20. The internal piston in the integral ram 22 in the outer sleeve 12 will retract and the attached top plate 18 will release from the load that was being raised/surface and was being supported. The hydraulic inlet and coupling 33 may then be released from the connection coupling 32 on the integral ram 22.

The removable pin 44 engaged through the spaced holes 50 in the inner/telescopic sleeve 14 may now be removed and whilst holding the connection coupling 32 of the integral ram 22 the removable pin 26 in the outer sleeve 12 may then also be taken out and the inner/telescopic sleeve 12 can be fully lowered to the point where the mounting boss 24 will meet and rest on the securement boss 17. The temporary support and raising device is now fully retracted.

To ensure that the inner/telescopic sleeve 14 cannot move during transportation, the adjustable collar 40 should be positioned directly above the lowest available spaced holes 50 in the inner/telescopic sleeve 14 by turning its attached arm 48 either clockwise or anti-clockwise, as required. The removable pin 44 for use with the inner/telescopic sleeve 14 is then placed through the section of thread 42 with two slots 46 at the top of the outer sleeve 12 and into the available spaced holes 50 in parallel once again and which will prevent slippage of the inner/telescopic sleeve 14 during transportation. The removable pin 26 for use with the outer sleeve 12 may then be placed into the pin storage bracket 29 which is fixed to the outside of the outer sleeve 12.

The present invention may provide a prop or support in five standard sizes in which the support 10 will at least provide the following maximum and minimum heights and the support 10 will at least support the following specified loads in those configurations:

Size (0) Min 1.5 m=40 kN=4.7 tons
Max 1.8 m=25 kN=2.5 tons
Size (1) Min 1.7 m=34 kN=3.4 tons
Max 2.8 m=14 kN=1.4 tons
Size (2) Min 1.9 m=40 kN=4.7 tons
Max 3.4 m–11 kN=1.12 tons
Size (3) Min 2.5 m=34 kN=3.4 tons
Max 3.9 m=8 kN=0.8 tons
Size (4) Min 3.1 m=20 kN=2.0 tons Max 4.9 m=7 kN=0.7 tons However, if the preferred embodiment, the maximum load tolerance is 4 tons and this may be defined by the capability of the ram.

The invention claimed is:

1. A support comprising:

an outer sleeve member;

an inner core member wherein the inner core member is at least partially inserted into the outer sleeve member and at least partially extended outwardly therefrom; and movement means which is arranged, in use, to move the inner core member outwardly from the outer sleeve member, wherein the movement means comprises a hydraulic ram;

wherein the movement means is mounted in a support at an adjustable position, and the support comprises a mechanical retraction prevention means to prevent the retraction of the inner core member from a support position, wherein the mechanical retraction prevention means comprises:

a collar engaged on a threaded outer surface of the outer sleeve member;

a slot defined in the outer sleeve member wherein the slot is at least partially within a threaded portion;

an aperture defined in the inner core member; and a retaining member which is locatable through the slot and the aperture, and in the support position, hydraulic pressure is releasable from the hydraulic ram in order for the mechanical retraction prevention means to be the sole retaining mechanism, in which, after the hydraulic pressure has been released, the hydraulic ram is arranged to be reactivated and extended in order to release the pressure to enable the collar to move downwardly and for the support to be subsequently removed.

2. A support according to claim 1 in which the hydraulic ram comprises a coupling which extends laterally from a main body and the coupling is arranged to extend through a coupling slot provided in the outer sleeve member.

3. A support according to claim 2 in which a buffer boss is located at a bottom of the outer sleeve member which restricts a lowermost position of the inner core member and wherein the coupling is spaced from a lowermost end of the coupling slot whilst the inner core member is supported on the buffer boss.

4. A support according to claim 1 in which the movement means is connectable to a pump and wherein the pump is removable through use of a releasable coupling.

5. A support according to claim 1 in which the support provides a top plate which is retained in position both by hydraulic pressure within the hydraulic ram and also by mechanical engagement of the collar such that the support provides a dual support safety system.

6. A support according to claim 1 in which the movement means is mounted in the outer sleeve member at an adjustable position.

7. A support according to claim 1 in which an initial length that the inner core member extends from the outer sleeve member is adjustable.

8. A support according to claim 1 in which the movement means is fixed to the inner core member and in which the movement means is slidably mounted in the outer sleeve member and is securable at an adjustable position within a length of the outer sleeve member.

9. A support according to claim 1 in which the hydraulic ram comprises a body and a piston wherein the piston is extendable from the body and retractable into the body, the hydraulic ram being moveably mounted in the outer sleeve member and in which the piston is extendable from the body by a maximum extension distance and the inner core member is extendable from the outer sleeve member by a maximum supporting distance and, in which, the maximum extension distance is less than the maximum supporting distance.

10. A support according to claim 1 in which the movement means is connectable to a pump and in which the pump is arranged to actuate the movement means.

11. A support according to claim 10 in which the pump is removably connectable to the movement means and the pump is subsequently able to actuate a plurality of supports.

12. A support comprising:

an outer sleeve member;

an inner core member wherein the inner core member is at least partially inserted into the outer sleeve member and at least partially extended outwardly therefrom; and movement means which is arranged, in use, to move the inner core member outwardly from the outer sleeve member, wherein the movement means comprises a hydraulic ram;

wherein the movement means is mounted in a support at an adjustable position, and the support comprises a mechanical retraction prevention means to prevent the retraction of the inner core member from a support position, wherein the mechanical retraction prevention means comprises:

a collar engaged on a threaded outer surface of the outer sleeve member;

a slot defined in the outer sleeve member wherein the slot is at least partially within a threaded portion;

an aperture defined in the inner core member; and a retaining member which is locatable through the slot and the aperture, and in the support position, hydraulic pressure is releasable from the hydraulic ram in order for the mechanical retraction prevention means to be the sole retaining mechanism, in which the collar is threadably moveable along the threaded portion from an unsupporting position to a supporting position in order for the retraction prevention means to be activated to prevent the inner core member from being retracted into the outer sleeve member.

13. A support according to claim 12 in which the collar is threadably moveable along the threaded portion to move to a support position in order for a load from a distal end of the inner core member to be transmitted through the pin to the collar and to the outer sleeve member and to a lower distal end of the outer sleeve member.

14. A method of supporting a structure comprising locating a support adjacent to a surface of the structure, the support comprising:

an outer sleeve member;

an inner core member wherein the inner core member is at least partially inserted into the outer sleeve member and at least partially extended outwardly therefrom;

movement means, wherein the movement means comprises a hydraulic ram; and mechanical retraction prevention means, in which the mechanical retraction prevention means comprises:

a collar engaged on a threaded outer surface of the outer sleeve member;

a slot defined in the outer sleeve member wherein the slot is at least partially within the threaded portion;

an aperture defined in the inner core member; and a retaining member which is locatable through the slot and the aperture and wherein, after the hydraulic pressure has been released, the method comprises:

reactivating and extending the hydraulic ram in order to release the pressure, moving the collar downwardly, and subsequently removing the support;

the method further comprising:

adjusting a position of the movement means in the support;

actuating the movement means and moving the inner core member outwardly from the outer sleeve member to a supporting position;

actuating the retraction prevention means to prevent the retraction of the inner core member from the supporting position; and releasing the hydraulic pressure from the hydraulic ram in order for the mechanical retraction prevention means to be a sole retaining mechanism.

* * * * *